US009475549B2

(12) United States Patent
Swan

(10) Patent No.: US 9,475,549 B2
(45) Date of Patent: Oct. 25, 2016

(54) CONVERTIBLE INFLATABLE BOAT WITH STAND UP PADDLEBOARD

(71) Applicant: Richard L. Swan, Reno, NV (US)

(72) Inventor: Richard L. Swan, Reno, NV (US)

( * ) Notice: Subject to any disclaimer, the term of this patent is extended or adjusted under 35 U.S.C. 154(b) by 0 days.

(21) Appl. No.: 14/816,645

(22) Filed: Aug. 3, 2015

(65) Prior Publication Data

US 2015/0336634 A1 Nov. 26, 2015

Related U.S. Application Data

(63) Continuation-in-part of application No. 14/193,308, filed on Feb. 28, 2014, now Pat. No. 9,126,655.

(51) Int. Cl.

| | |
|---|---|
| ***B63B 35/00*** | (2006.01) |
| ***B63B 7/08*** | (2006.01) |
| ***B63B 35/79*** | (2006.01) |
| ***B63H 16/06*** | (2006.01) |
| *B63B 35/73* | (2006.01) |

(52) U.S. Cl.

CPC ..... *B63B 7/082* (2013.01); *B63B 7/085* (2013.01); *B63B 7/087* (2013.01); *B63B 35/79* (2013.01); *B63B 35/795* (2013.01); *B63B 35/7913* (2013.01); *B63H 16/06* (2013.01); *B63B 2035/738* (2013.01)

(58) Field of Classification Search

CPC ..... B63B 7/082; B63B 7/085; B63B 7/087; B63B 35/7913; B63B 35/79; B63B 35/795; B63H 16/06

See application file for complete search history.

(56) References Cited

U.S. PATENT DOCUMENTS

2007/0209219 A1* 9/2007 Ertmer ..... G01B 3/04 33/511
2011/0036284 A1* 2/2011 Chon ..... B63B 3/38 114/345

* cited by examiner

*Primary Examiner* — Stephen Avila
(74) *Attorney, Agent, or Firm* — Southeast IP Group, LLC.; Thomas L. Moses; Cameron C. Applegate

(57) ABSTRACT

An inflatable shallow draft fishing boat having a removable, inflatable paddleboard floor that provides stable flotation for at least two standing adults, the boat also including an adjustable, detachable rowing frame. The boat can be maneuvered and propelled by oars, a push pole or a small motor. A detachable rowing frame allows the rower to switch his rowing position from facing the stern (for best speed) or face the bow (for better visibility when searching for fish). The paddleboard floor may be held in place by frictional engagement when the boat and the paddleboard are inflated; alternatively, the paddleboard may be removed and function independently as a stand-up paddleboard that can be used for fishing, swimming, or similar recreational water sports. The transom may be shortened for navigating rocky rivers, and measurement markings may be included on the outer side for measuring fish while the fish remain in the water.

12 Claims, 11 Drawing Sheets

CONVERTIBLE INFLATABLE BOAT WITH STAND UP PADDLEBOARD

BACKGROUND OF INVENTION

The sport of fishing for bone fish, permit and tarpon has been growing in popularity for half a century. The sport commonly referred to as "flats fishing" requires anglers to pursue their query on salt water flats which range from a few inches to a couple of feet in depth. A number of hard shelled boats, generally called flats boats or flats skiffs, have been designed to carry fishermen to and upon these productive salt water shallows. The problem is these craft are expensive, require substantial vehicles with trailers for transport and require a large commitment of time and money to store and maintain them.

Inflatable boats have been in use for decades. A common design includes two parallel side tubes that curve together in the front forming a bow. In the stern, the two parallel side tubes attach to and are connected by a transom. A bottom piece is glued or welded to the bottom of the side tubes, transom, and bow forming a water proof seal resulting in a conventional inflatable boat with a dry interior.

Sport fishermen need to measure the length of the fish they catch for a number of reasons. Most fish and game regulations require that fish must be a certain length for the angler to keep a fish they have landed while sport fishing. Trophy fish need to be measured to verify if it is a state, national or world record. Many times anglers want to measure their catch just to document the size. Often times this is true even if they intend to release the fish. A measuring device is desirable to document the size and allows a photo to be taken to confirm the size of the fish.

In fact, over the past 60 or so years a number of sportsmen's organizations have been promoting the idea of carefully releasing fish of all sizes to care for and preserve our valuable stocks of sport fish. A number of fish measuring devices have been marketed over the years but they require the fish to be taken out of the water. For instance ice chest makers provide measuring devices on the top of their coolers.

Fish biologists and sport fishing organizations have established best practices to ensure that fish are released in good condition and have the best chance to survive and thrive once they are released. Some of the most important rules in this process are to keep the fish in the water; use barbless hooks; and, handle the fish as little as possible. One aspect of this invention is to provide an easier method for the angler to measure and photograph the catch, while at the same time increasing the chance for survival of the fish.

Stand up paddleboarding (SUP) has been growing in popularity for several years now and offers a fun, relaxing way to enjoy the water. This aquatic activity involves employing an oversized surfboard in combination with a paddle for propulsion. With a minimum of gear, you can paddle ocean surf, lakes and rivers with no waves required. A paddleboard is light and easy to transport, so one can easily access water that boats cannot. Additionally, paddleboarding delivers a full body workout and has become a popular cross-training activity. The paddleboards available on the market today include rigid foam or fiberglass boards and inflatable boards.

Inflatable stand up paddleboards have been in use for several years and are constructed by making an inflatable drop stitch (DS) air-tight envelope of PVC impregnated polyester fabric or other coated or impregnated fabric into the shape of a conventional paddleboard that can be inflated through a valve. This drop stitch manufacturing creates a board that may be inflated to very high pressures, resulting in rigidity similar to a hard board. Some benefits of inflatable boards over hard boards are their durability and transportability.

One object of the present invention is to provide a light weight inflatable boat that includes a conventional inflatable paddle board designed to closely fit inside the floor of the boat, so that when both are inflated the resulting air pressure and friction firmly join the two together. This combination makes it possible for two people to stand up and cast fishing lines, stand up and pole with a push pole, stand up to search for fish, or use the resulting stable platform to dive or step into the water. Another object of this invention is to provide measurement marks on the sides and top of a watercraft for easy and safe measurement of a catch. An essential part of this invention is that the boat can be deflated, and the paddleboard floor can easily be removed, re-inflated and used as an inflatable stand up paddleboard. This version of watercraft is portable in the trunk of a medium sized automobile or SUV and can be owned and operated at a fraction of the cost of the larger, heavier, flats craft which are made out of rigid materials such as wood, fiber glass, or metal.

None of the prior art discloses or describes an inflatable boat designed to have an inflatable paddleboard floor that provides stability for fishing and diving, wherein the floor can be removed and function independently as a stand up paddleboard.

SUMMARY OF THE INVENTION

It is a general object of the present invention to improve the utility of the prior art of inflatable boats and stand up paddleboards by incorporating the two into a single, easily portable watercraft. Provided is an inflatable boat including a stand up paddleboard functioning as the floor of the boat, wherein the paddleboard may be removed and used independently as a watercraft.

An example paddleboard comprises a floating body having a long midline axis, a bow end, a stern end, a top surface and a bottom surface. The top region optionally comprises a slip resistant material, which can optionally extend from the bow to the stern. The paddleboard further comprises a deck region located on the top surface on which a user stands to operate the stand up paddleboard. The deck region alone can optionally comprise the slip resistant material.

A further object of the present invention is to construct an inflatable boat and paddleboard which can be easily maneuvered as one or separate units in shallow water by oars, push pole, paddle, or electric motor.

A further object of the present invention is to construct an inflatable boat which is suited for rod and reel fishing methods on shallow water flats and particularly for fishing for bone fish, tarpon, snapper and permit as well as suited for slow-moving rivers and shallow fresh water fishing for bass, carp, panfish, and trout.

A further object of the present invention is to construct an inflatable boat/paddleboard combination which is affordable, can be transported in the trunk of an automobile, and can be stored in a closet or small storage room.

Yet another object of the present invention is to construct an inflatable boat which does not unduly alarm the shallow water game fish targeted by the user.

Yet another object of the present invention is to construct an inflatable boat which provides a convenient elevated platform for the person maneuvering the craft by push pole to step up on a platform and achieve a higher elevation for improved viewing of game fish. In one embodiment, an ice cooler held in place by a detachable metal frame may provide such a platform.

Still another object of the present invention is to construct an inflatable boat which can be maneuvered by rowing and said person can easily shift his rowing position from facing the stern to facing the bow so he can more accurately maneuver the boat to an advantageous position to cast to approaching fish.

An additional object of the present invention is to construct an inflatable boat in which the operator can sit on a rowing seat near the stern and operate a small gas or electric motor with the optional assistance of a tiller extension.

Still another object of the present invention is to construct a stand up paddleboard that is stable enough for a person to stand on and cast for fish.

Yet another object of the present invention is to construct a stand up paddleboard that may include a plurality of attachment mechanisms to allow for easy and secure attachment of fishing and outdoor gear such as a cooler, paddles, fishing rods, life preservers, nets, and the like.

Another object of the present invention is to construct an inflatable boat with a shortened transom to allow for easy navigation in rocky rivers and over shallow, rocky waters.

And yet another object of the present invention is to construct a watercraft with measurement markings included on the side and upper surface of the watercraft for the measuring of fish during catch and release fishing.

DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
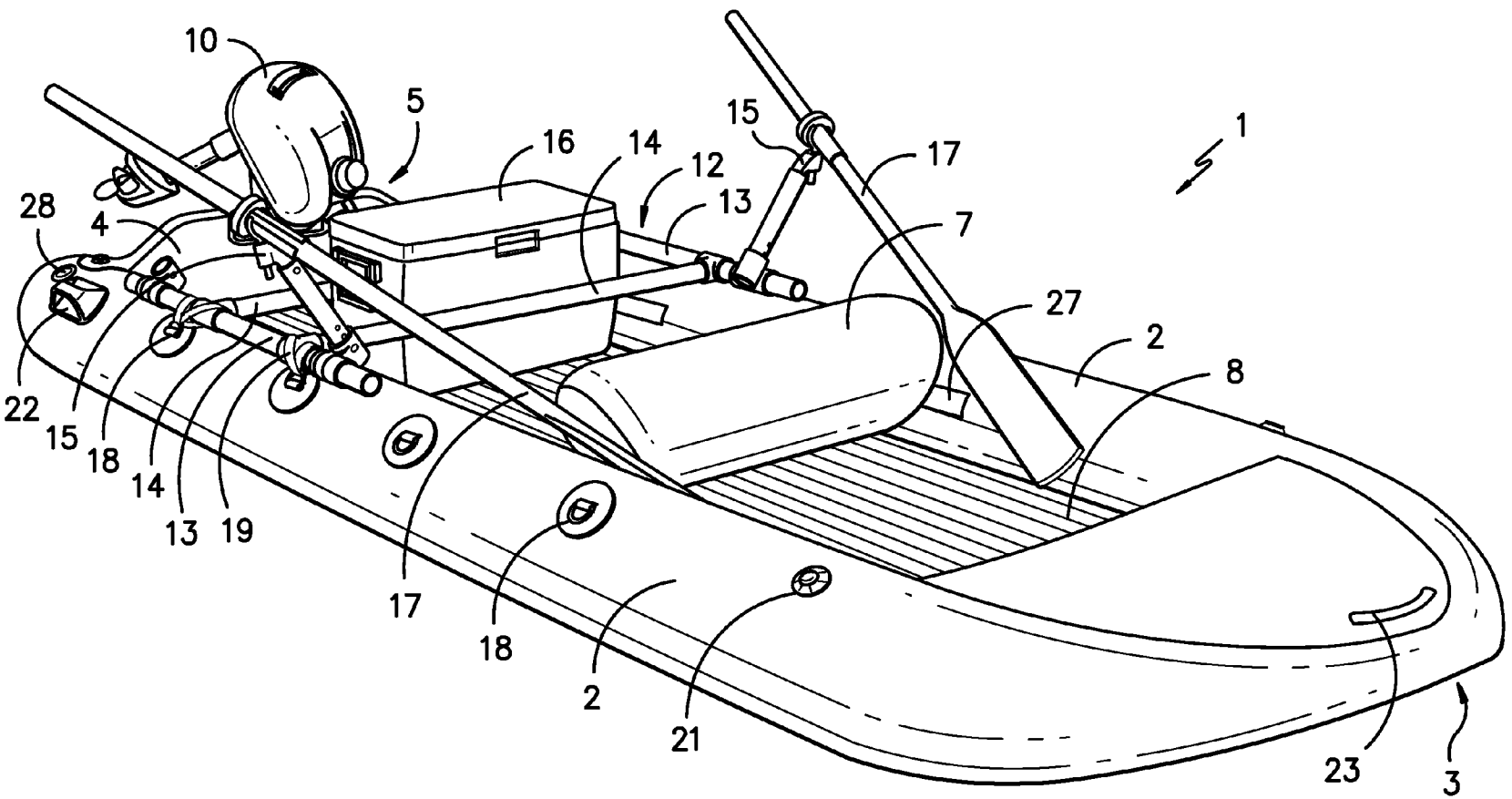
FIG. 1 illustrates a perspective view of the inflatable boat with stand up paddleboard floor, further including the rowing frame with oar locks and cooler seat.

In one embodiment, the sides of an inflatable boat 1 are defined by two elongated tubes 2 preferably about 12.5 feet long, forming a boat about 4 feet wide. The two side tubes 2 come together in the front to form a bow 3 and may further curve up near the bow 3 about 12 inches to help prevent waves from breaking over the bow 3 and into the boat 1 when underway. The two side tubes 2, preferably about 11 inches in diameter, connect to a transom 4 on the stern end. The stern 5 may have a motor mount portion 9 which includes sufficient strength and rigidity to attach a small outboard motor 10 or a small electric motor 10. A plastic or rubber bottom member 6 is attached with a watertight seal at the bottom of the side tubes 2 from the tip of the bow 3 to the bottom of the transom 4 to form the bottom of a watertight vessel or boat. An inflatable, removable thwart 7 may be used to provide a seat near the bow 3. It may be held in place by hook and loop tape 27, for instance, which connects it to the inside of each side tube 2. The inflatable components of this watercraft may include at least one valve 28 for inflation and at least one pressure relief valve 21.

The inflatable boat 1 may also include an ice cooler 16 used as a rear seat, which preferably sits about 2 feet ahead of the stern 5. This cooler/seat 16 is held in place by a rectangular frame 12 (also referred to herein as a "rowing frame"), which may include oarlocks 15 located on both ends of the side tubes 2. The rowing frame 12 preferably consists of 4 support members. Two lateral support members 14 run perpendicularly across the boat 1 and attach to two longitudinal support members 13 that rest on and are parallel to the inflated side tubes 2. In one embodiment, each of these longitudinal support members 13 of the frame 12 may extend about 12 inches past the lateral support members 14 toward the bow 3 on the front side of the cooler 16 and about 12 inches toward the stern 5 on the back side of the cooler 16. When the paddleboard 8 is removed from the boat 1, the oars 17 may be removed from the oarlocks 15 and used to propel the paddleboard 8.

The cooler 16 may be placed into the rowing frame 12, and may be removed when not in use. At least one pair of removable, adjustable oarlocks 15 may be provided along an upper portion of the inflatable side tubes 2 in such a way as to allow the person rowing to switch orientation from facing the stern 5 to facing the bow 3, which allows him to see fish and more effectively maneuver the boat 1 in favor of the person fishing in the front of the boat 1. The oarlocks 15 may be adjustable in such a way that they may slide along the longitudinal support members 13 and may be adjusted to accommodate the height of the rower. The frame 12 is preferably adjustable so that it can securely lock different sized coolers in place as a seat for rowing. This adjustability may be accomplished by providing the lateral support members 14 to slide in either direction along the longitudinal support members 13 and then be locked into a desired position. The cooler 16, while in place within the frame 12, may be used as a seat for operating a small horsepower motor 10. And the cooler 16 may also be used as push-pole poling platform to pole the boat 1 from an elevated station, which is advantageous for spotting fish. In an alternate embodiment, a seat/platform can be formed by building a seat into the frame 12 from wood, plastic, or other suitable material.

In one embodiment, the frame 12 may be detachable and held in place, for instance, with D rings 18 and straps 19 or cords to steady the cooler seat 16 when being used as a poling platform or as a rowing seat. The rowing frame 12, in a preferred embodiment, is collapsible when removed from the boat 1 for easy transport with the deflated boat in the trunk of a car. This collapsibility may be accomplished through snap-fit joints, folding joints, or other similar connection mechanisms. The rowing frame 12 may position the cooler seat 16 about 24 inches from the stern 5. When the boat 1 is being maneuvered with the push pole, the poling person can easily step up from his position behind the cooler 16 to the top of the cooler 16 for better visibility. He can also sit on the cooler 16 when operating a small out board gas or electric motor 10.

It should be noted that the boat 1 may be operated in a variety of ways and embodiments. The rowing frame 12 is optional, and the boat 1 may be operated without the frame 12 in place. A person may paddle, pole, or motor the boat 1 while the frame is detached. Additionally, the motor 10 may be removed, and the boat 1 may be operated exclusively by poling or paddling.

In a preferred embodiment, at least one drain 25 may be disposed in the bottom of the boat 1, preferably centrally located on the bottom of the transom 4 or in the stern 5 end of the boat 1, allowing water that splashes in the boat 1 to drain out. The drain may be a scupper or a drain with a plug or screw cap, or other suitable structure to facilitate drainage and removal of water. A bow cover 20 may extend back from the bow 3 about 24 inches, thus creating a storage area that allows stowage of rain coats shoes and other gear. The boat 1 is preferably white in color on sides and tops of tubes to reflect sun light so the craft is less visible to fish. White is the color of most fish eating sea birds for the same reason, and is therefore advantageous for fishing purposes.

One or more D-shaped plastic fins 26 may be attached to the bottom of the boat 1 to improve directional stability. The straight side of the D-shaped fin 26 is parallel to the bottom of the boat 1. In a one embodiment, a D-shaped fin, preferably 6 inches in length and extending into the water about 2 inches, may be permanently attached to the stern end of each side tube 2.

The top side of the bow 3 may include a carrying handle 23 and the underside of the bow 3 preferably has a large D ring 18 to which a bow line can be attached to secure the boat 1 to a dock, piling or anchor. The stern of both side tubes 2 each may include a similar carrying handle 22 and may also be used to tie the boat 1 off to a dock or mooring.

Figure 2:
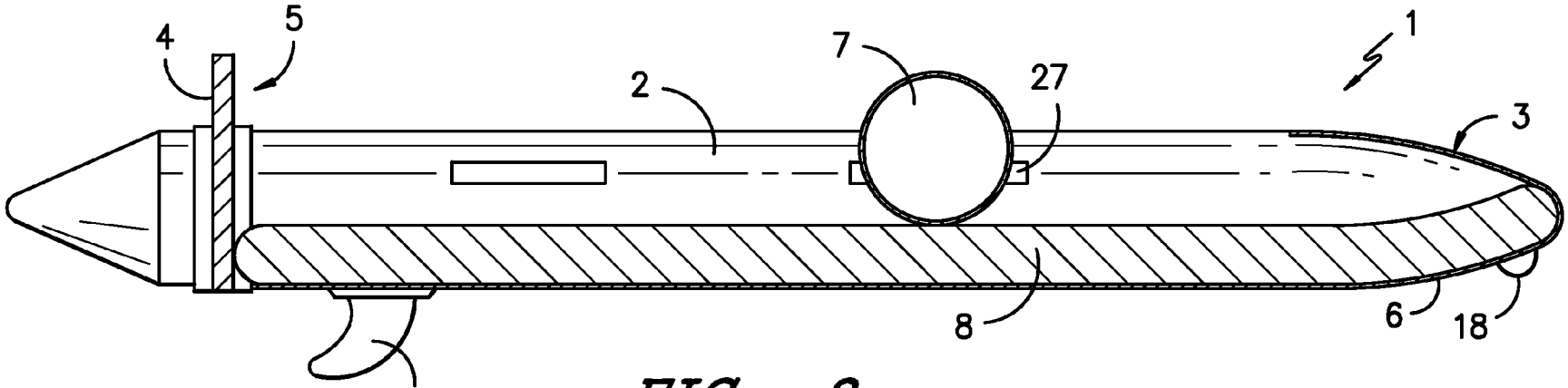
FIG. 2 illustrates a longitudinal cross-sectional view of the inflatable boat with stand up paddleboard floor.
Figure 3:
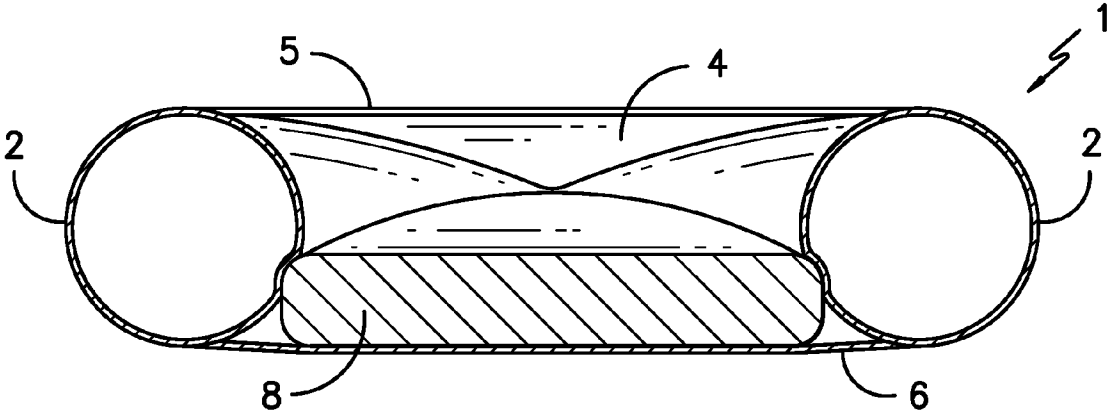
FIG. 3 illustrates a transverse cross-sectional view of the inflatable boat with stand up paddleboard floor.
Figure 4:
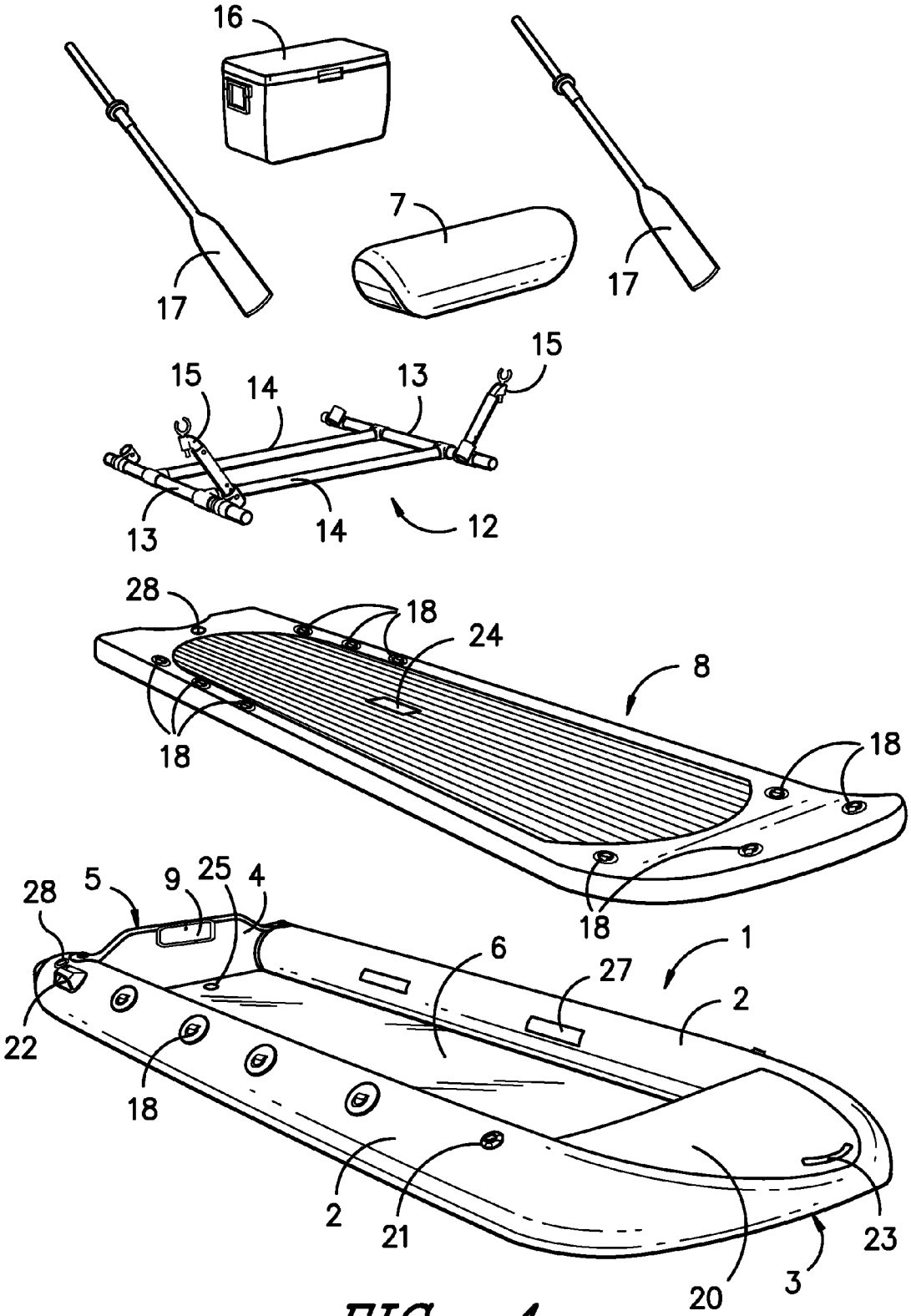
FIG. 4 illustrates an exploded view of the inflatable boat, inflatable stand up paddleboard, rowing frame, removable thwart, cooler seat, and oars.
Figure 6:
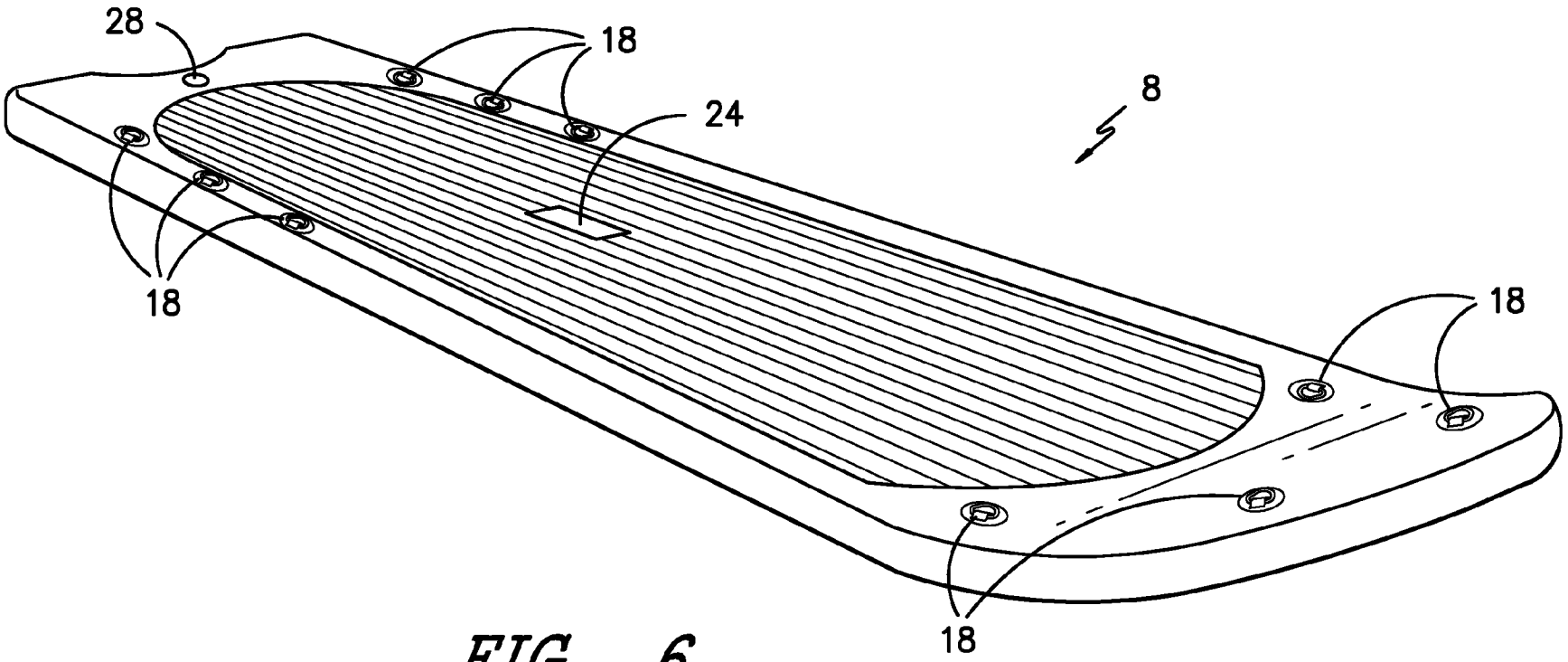
FIG. 6 illustrates a perspective view of the inflatable stand up paddleboard.

A removable, inflatable paddleboard 8 preferably 6 inches thick sits just above the bottom member 6 and inside the boat 1. The combination of the inflated boat 1 and the inflated paddleboard 8 creates a buoyant, stable boat with a firm floor allowing two adults to stand up and cast fishing lines from the boat 1. One embodiment of the paddleboard alone is shown in FIG. 6, while the combination of inflatable boat and paddleboard is illustrated by FIGS. 2 and 3.

The paddleboard 8 is held securely in place directly above the bottom member 6 of the boat 1 by a tight fit that may be accomplished through static friction resulting from air pressure between the side tubes 2 of the boat 1 and the sides of the paddleboard 8. The paddleboard 8 may be shaped to contact the inside edges of the side tubes 2 and transom 4 of the boat 1, preferably tapered and rounded on the bow end giving the paddleboard 8 a typical bow shape, while being squared off on the stern end to fit against the transom 4, as shown in FIGS. 2 and 3. In a preferred embodiment, the bow end of the paddleboard 8 may end about 9 inches from the bow 3 of the boat 1, resulting in a paddleboard 8 with a length of about 10.5 feet.

In a second embodiment, the sides of the paddleboard 8 may extend at a downwardly angle to fit in a space existing between the bottom member 6 of the boat 1 and the inflated side tubes 2 of the boat 1. This alignment makes a connection similar to a tongue and groove fit between the inflatable paddleboard 8 and the inflated side tubes 2, forming a tighter fit inside the boat 1.

In an alternative embodiment of the invention, the paddleboard 8 and side tubes 2 may be connected more securely through an attachment device such as hook and loop strips 27, straps or another similar connecting device. Hook and loop strips 27 may be affixed to the side tubes 2, subsequently passing through loops affixed to the sides of the paddleboard 8, and then reattaching to the hook and loop strips 27 on the side tubes 2. Similarly, hook strips 27 may be affixed to the side tubes 2 and positioned to attach to loop strips 27 that may be affixed to the sides of the paddleboard 8.

The design of the inflatable boat 1 with inflatable paddleboard 8 floor is such that the paddleboard 8 may be removed and used as an independent watercraft. When at least one side tube 2 of the boat 1 is deflated, the air pressure drops, thereby loosening the frictional engagement between the side tubes 2 and the paddleboard 8. This loosening allows the paddleboard 8 to be separated and easily removed from the boat 1. The paddleboard 8 floor can then be used separately as an inflatable stand up paddleboard 8. The paddleboard 8 preferably includes a centrally located handle 24 to facilitate removal and transportability. It should be understood that the paddleboard 8 may contain any number of handles in any desired location(s) on the paddleboard 8, such as the center, sides, bow, stern, or any combination thereof. Any number of D rings 18 may be strategically attached to the paddleboard 8 for the securing and attachment of gear such as a cooler 16, paddles 17, fishing equipment, anchors, and the like. Additionally, these D rings 18 may be used to strap the paddleboard 8 to a vehicle or may be used for towing purposes. The paddleboard 8 may also be deflated, if necessary, for removal from the boat 1, transportability, and storage. This may be accomplished by releasing air from the inflation valve 28.

Figure 7:
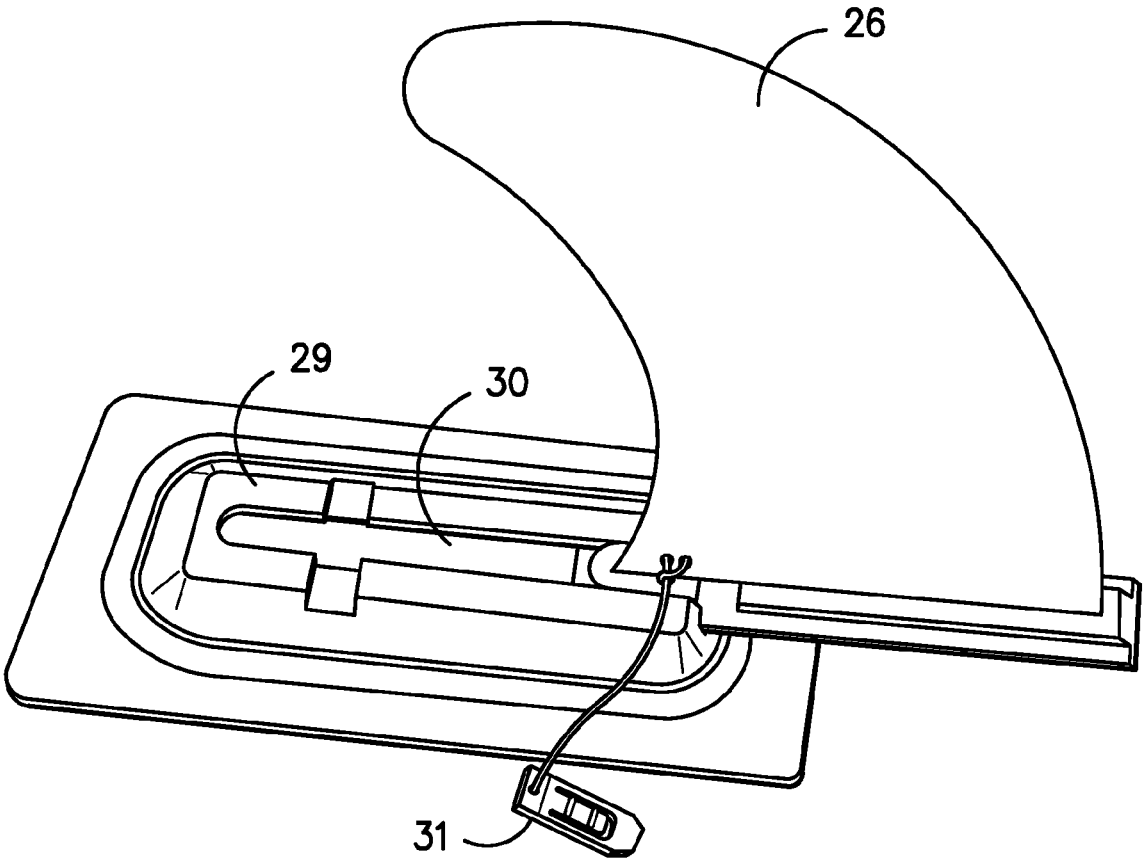
FIG. 7 illustrates the removable paddleboard fin as it slides into the groove of the track.
Figure 8:
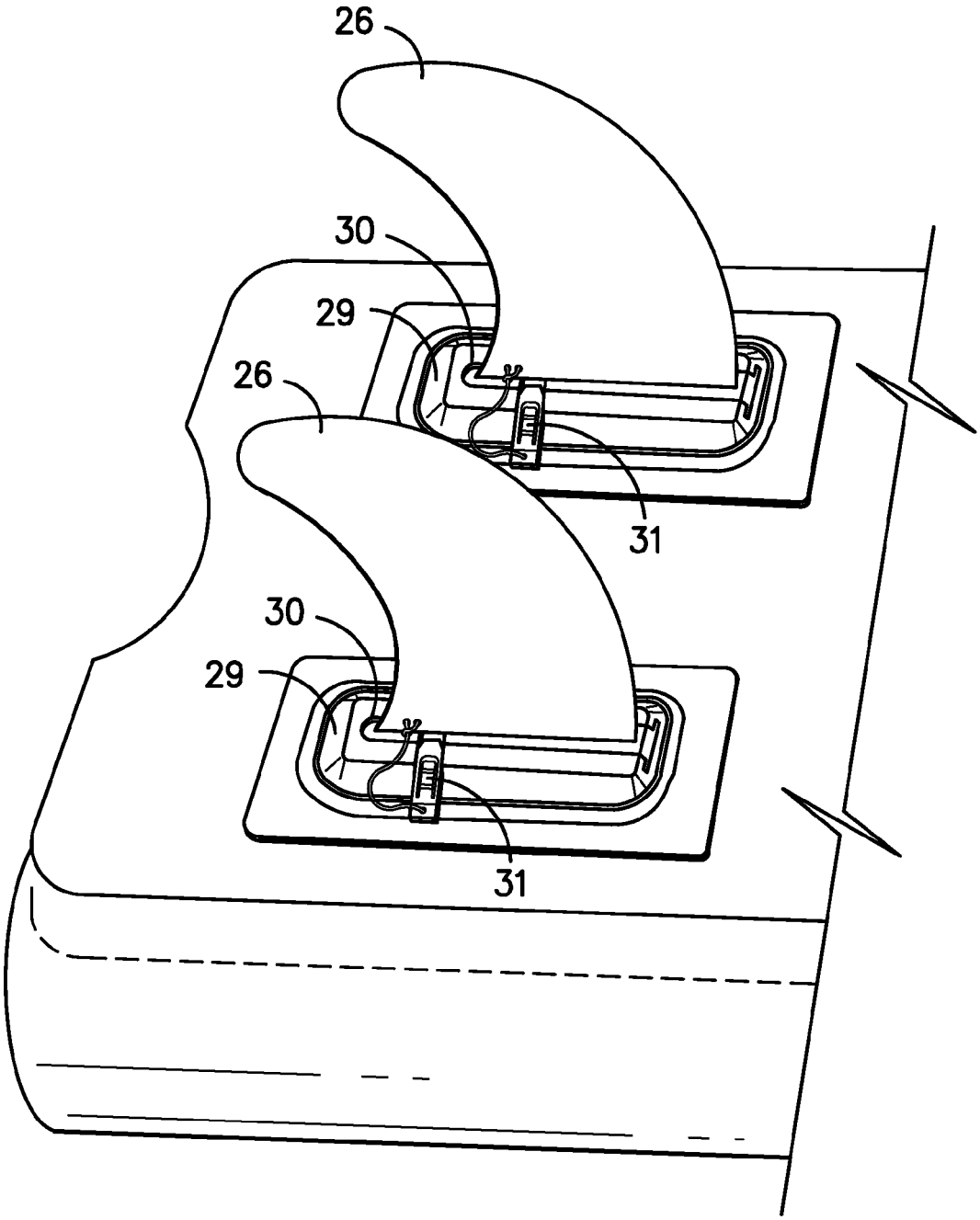
FIG. 8 illustrates the removable paddleboard fin fully engaged in the track with insertion of a locking pin.

Additionally, the paddleboard 8 may include at least one removable fin 26 which may attach near the stern of the paddleboard 8. In a preferred embodiment, a track 29 may be permanently affixed to the bottom or water-side surface near the stern end of the paddleboard 8 whereby a fin 26 may slide into a groove 30 of the track 29 and further be secured by a locking pin 31 or the like, as shown in FIGS. 7 and 8. These fins 26 may be provided to improve directional stability of the paddleboard 8. Similarly, the removable fin mechanisms may also be attached to the bottom of the boat, if desired.

Figure 5:
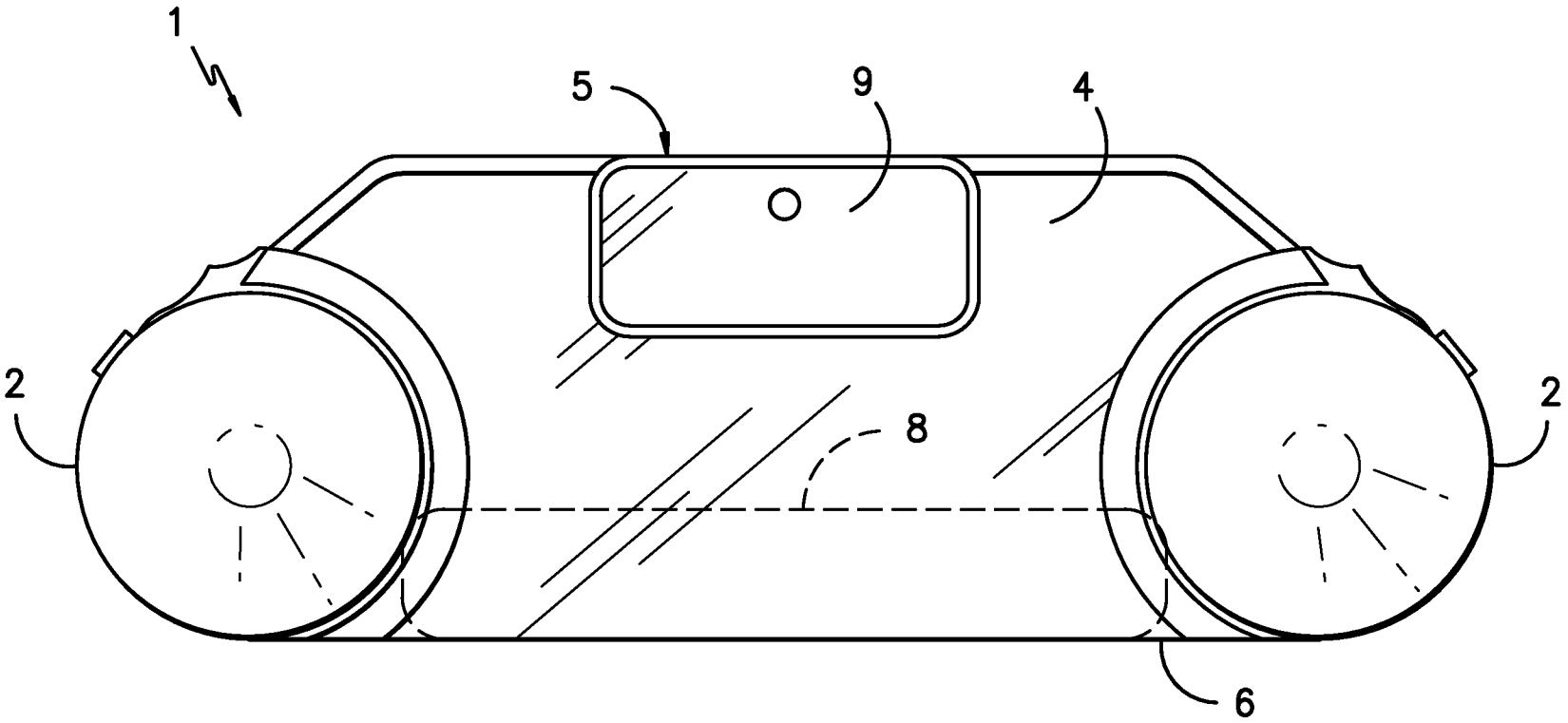
FIG. 5 illustrates a rear view of the stern end of the inflatable boat with stand up paddleboard.
Figure 9A:
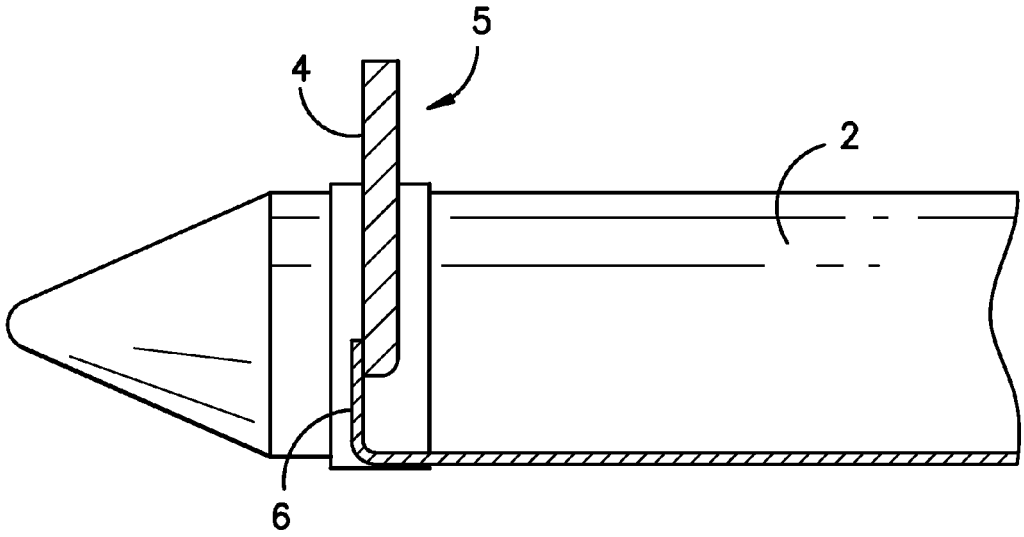
FIG. 9A illustrates a longitudinal cross-sectional view of the stern end of the inflatable boat with a shortened transom.
Figure 9B:
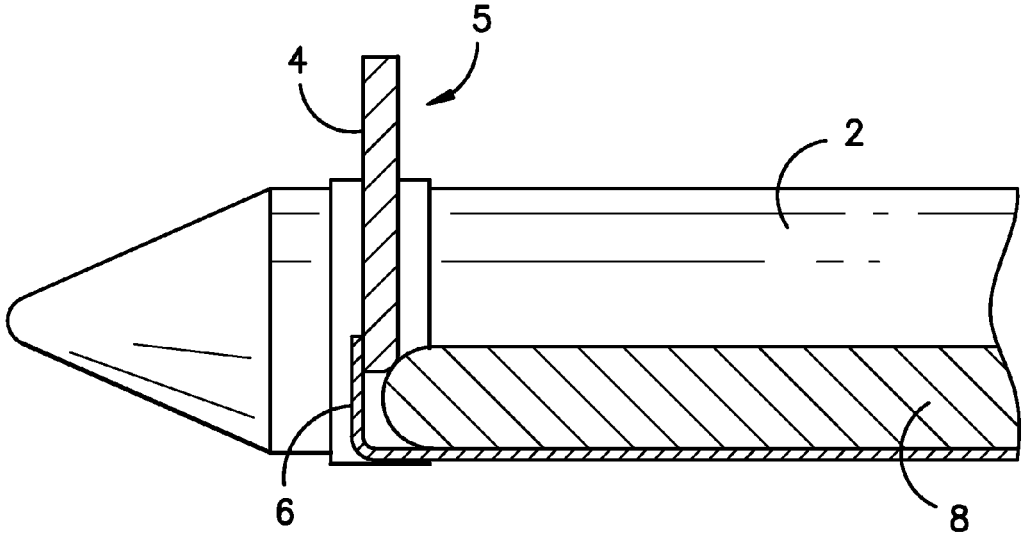
FIG. 9B illustrates a longitudinal cross-sectional view of the stern end of the inflatable boat with a shortened transom and inflatable stand up paddleboard floor.

FIG. 5 illustrates a rear view of the stern of one embodiment of the inflatable boat 1 showing a full length, rigid transom 4 running flush to the bottom member 6 of the boat 1. In an alternative embodiment, the inflatable boat 1 may have a rigid, shortened transom 4, whereby the transom 4 stops short of the bottom member 6 of the boat, leaving a gap between the bottom edge of the transom 4 and the bottom member 6 of the boat, as shown in FIGS. 9A and 9B. If a watercraft is being used to navigate or float on rocky rivers or rapids, the shortened transom 4 provides a gap which allows more flexibility to the bottom surface of the boat as it travels in more shallow, rocky water. With a rigid transom 4 running flush to the bottom member 6, one may run the risk of the boat getting caught or hung up on rocks, resulting in a potentially dangerous situation. If the transom 4 is shortened, the bottom surface of the boat 1 provides more give and may glide more easily over rocks.

Figure 10:
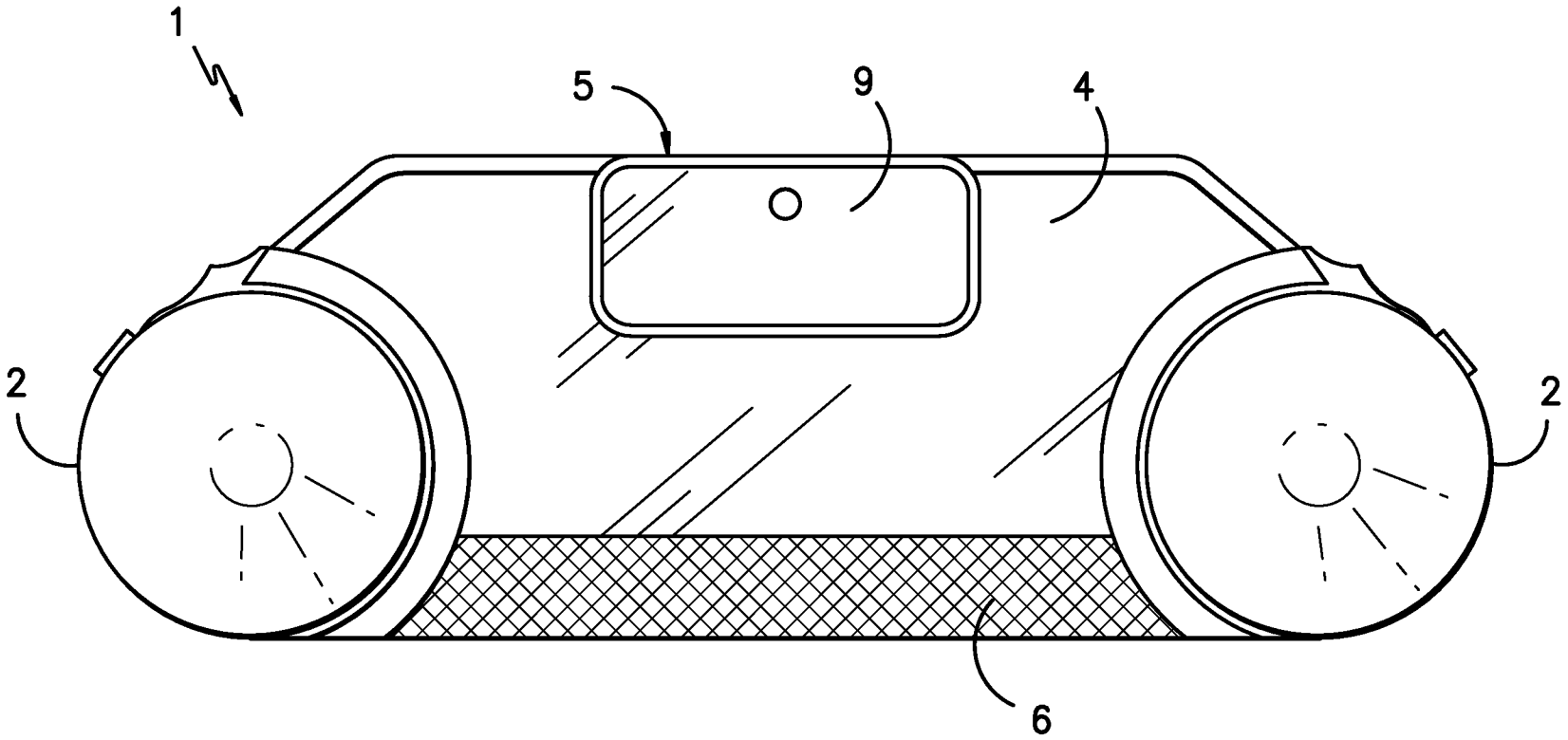
FIG. 10 illustrates a rear view of the stern of the inflatable boat with a shortened transom.

This gap is preferably approximately 4 inches in height, but may be more or less as desired. In a preferred embodiment, the bottom member 6 of the boat is folded up to meet the shortened transom 4; in this way, the boat may remain watertight. FIG. 10 shows one embodiment of a rear view of the stern whereby the bottom member 6 is pulled up to meet the bottom of the shortened transom 4. The bottom member 6 may be secured to the shortened transom 4 by glue, adhesive, or any other suitable securing means. Additionally, a reinforcing heavy V-tape may be added at the corner where the bottom member 6 folds up to meet the transom 4 for extra support and reinforcement. When the paddle board 8 is inserted, it preferably fits flush to the shortened transom 4, as shown in FIG. 9B. And, depending on the height of the gap as compared to the height of the inflated paddle board 8, the edge of the paddle board 8 may push slightly inward and under the gap, adding further support and rigidity to the bottom of the boat 1.

Figure 11:
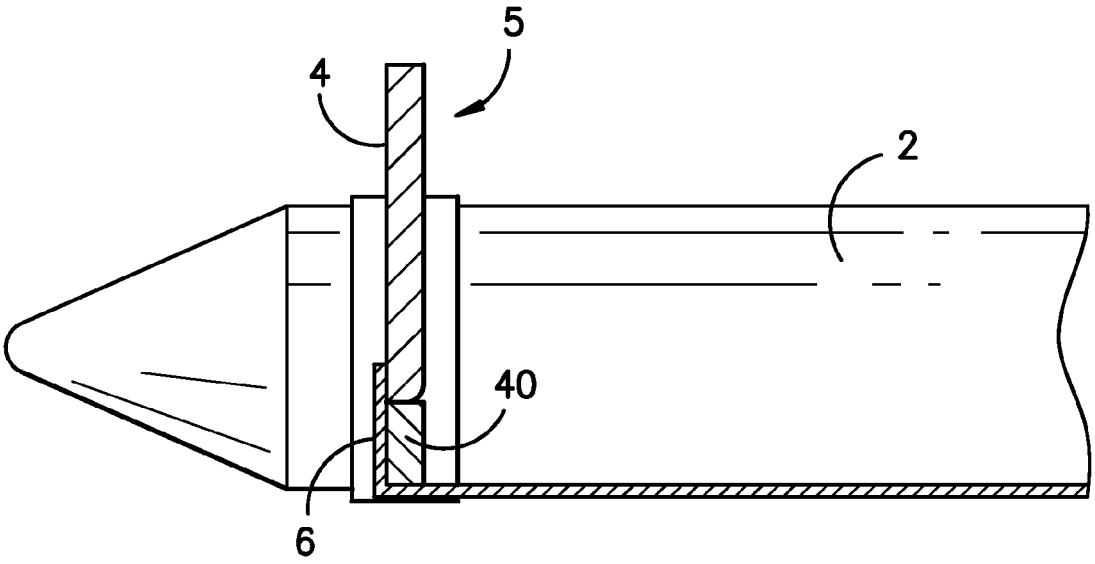
FIG. 11 illustrates a longitudinal cross-sectional view of the stern end of the inflatable boat with a shortened transom and an optional support member inserted beneath the transom.
Figure 12:
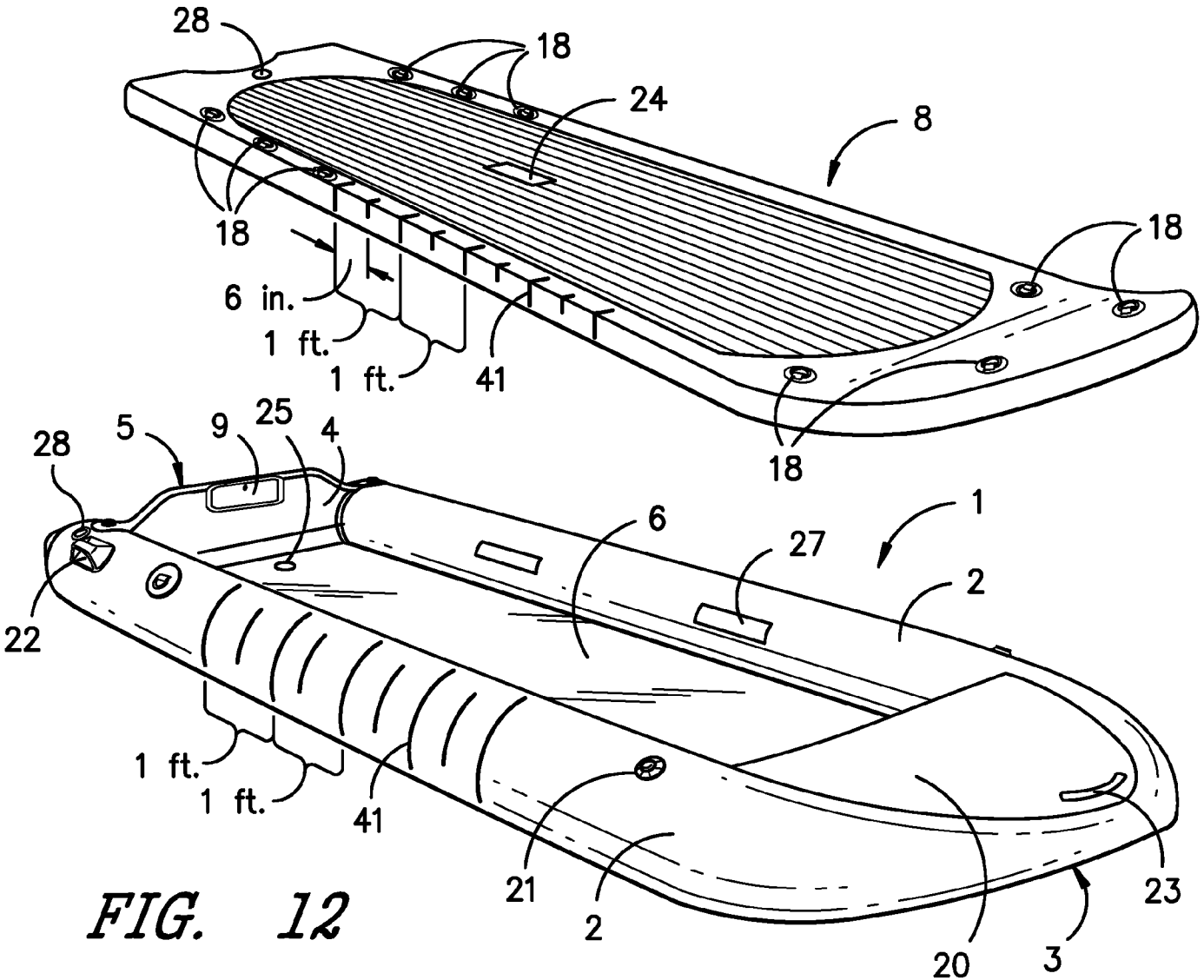
FIG. 12 illustrates an exploded view of the inflatable stand up paddleboard and inflatable boat, both with exemplary measurement markings along the top and side of each.

There are some circumstances in which a full rigid transom may be favorable. In the event that a motor is being mounted on the motor mount 9 of the transom 4, more rigidity may be desired in order to fully and safely support the weight of the motor. Also, if the boat is being used in deeper water, a shortened transom may not be needed. For these purposes, an optional insertable support member 40 may be provided, as shown in FIG. 11. Preferably, the height of the support member 40 may be approximately equal to the height of the gap between the transom 4 and the bottom member 6, such that when the support member 40 is inserted, the transom 4 may provide a comparable level of stability and rigidity as a full transom.

In a preferred embodiment, the optional insertable support member 40 may be inserted directly below the shortened transom 4. This insertion may be accomplished through a tongue and groove fit, a slidable track, or another suitable method. It is contemplated that the optional support member 40 may be inserted while the boat is deflated, so that the member 40 may more easily be inserted into position underneath the transom 4. Following placement and positioning of the support member 40, the boat may be inflated, thus tightening the position of the support member through frictional engagement between the side tubes 2 of the boat and the bottom edge of the transom 4. If the support member 40 is no longer needed, the boat may be deflated and the member 40 may easily be removed.

In an alternative embodiment, the optional support member may slide downward along a track or tongue and groove mechanism that may run laterally down the interior of the side tubes 2, preferably directly adjacent to the location of the shortened transom 4. In this manner, the support member may be inserted and removed, by sliding upward and downward, while the boat remains inflated. A securing mechanism, such as a latch or other suitable mechanism, may be used to secure the support member 40 in place once inserted.

The present invention may also include a set of measurement markings 41 on both sides of the inflatable boat 1 and paddle board 8, located preferably just toward the bow from the mid point of the boat and board. These markings are preferably located on the top and sides to allow a fish, once landed, to be brought up along the markings to determine the length of the fish. This measurement can be taken while the angler is on the boat 1 or paddle board 8 looking down at the fish, or it can be done if the angler is wading in shallow water next to the boat 1 or board 8. In either case, one can lead the fish along the markings and get a very good idea of the size of the fish without ever taking the fish out of the water. The location of the measurement markings 41 also make it easy for the angler to snap a photo of the fish while it is still in the water.

In a preferred embodiment, the marks consist of a set of marks similar to the marks on a ruler or yard stick. The marks are preferably a total of 4 feet in length with linear marks located every foot, in addition to smaller marks at the 6 inch distance after each foot marking. Although 4 feet is the preferable length, it should be understood that any number of marks may be used marking any desired length. It is also to be understood that the marks may be located at different intervals such as inch marks, six inch marks or other distances or any other measurement system such as the metric system. It should also be clear that this invention could apply to a number of different small craft such as kayaks, row boats, or small motorboats and is not limited to the inflatable boat and paddle board of the current invention. The marks could appear in different places and different colors, and may be made from a reflective material to make them easy to see from within or outside the craft.

Although the inflatable boat 1 and stand up paddleboard 8 set forth herein may be described in terms of specific dimensions, it should be understood that these dimensions are used for illustrative purposes only, and other dimensions, shapes and sizes may be used while adhering to the spirit and scope of the present invention. Additionally, it is within the scope of the present invention that embodiments of this design could be used as a yacht tender.

What is claimed is:

1. A watercraft comprising:

a port side and a starboard side, each having a first end and a second end, connected together at said first ends to form a bow;

a transom having a port end and starboard end;

the second end of said port side and the second end of said starboard side being connected to opposed ends of said transom, forming a stern;

a bottom member attached in a water tight manner to the port and starboard sides of said boat and extending from said bow to said stern, forming a substantially watertight bottom; and an inflatable paddleboard that may be removably positioned on top of said bottom member, whereby said paddleboard is capable of being removed and used independently as a paddleboard.

2. The watercraft set forth in claim 1, whereby said stern is adapted for attachment of a motor.

3. The watercraft set forth in claim 1, further including a rowing frame attached to said port side and said starboard side.

4. The watercraft set forth in claim 1, whereby said port and starboard sides are inflatable.

5. The watercraft set forth in claim 4, whereby said transom is shortened such that a gap is provided between said transom and the watertight bottom of said boat.

6. The watercraft set forth in claim 5, whereby said bottom member is affixed to a bottom edge of said shortened transom such that said watercraft is watertight.

7. The watercraft set forth in claim 5, further including a removable support member capable of being inserted underneath said transom, such that said support member substantially fills said gap and provides support and rigidity to said transom.

8. The watercraft set forth in claim 1, further including lengthwise measurement markings displayed on at least one outer side and at least one upper surface of said boat, such that a fish may be drawn up against said boat and measured while said fish remains in the water.

9. An inflatable boat comprising:

A pair of elongated, inflatable tubes forming the sides of a boat, having a first end and a second end;

said tubes connected to each another at said first end, forming a bow;

a transom having a port and starboard ends;

the second end of each of said tubes connected to opposed ends of said transom, forming a stern;

a bottom member attached in a water tight manner to said tubes and said transom, said bottom member extending from said bow to said stern, forming a substantially watertight bottom; and whereby said transom is shortened such that a gap is provided between said transom and said watertight bottom.

10. The inflatable boat set forth in claim 9, whereby said bottom member is affixed to a bottom edge of said shortened transom such that said boat is watertight.

11. The inflatable boat of claim 9, further including a removable support member capable of being inserted underneath said transom, such that said support member substantially fills said gap and provides support and rigidity to said transom.

12. The inflatable boat of claim 9, further including lengthwise measurement markings displayed on at least one outer side and at least one upper surface of said watercraft, such that a fish may be drawn up against said watercraft and measured while said fish remains in the water.

* * * * *